United States Patent [19]

Mertens et al.

[11] 4,135,948

[45] Jan. 23, 1979

[54] METHOD AND APPARATUS FOR SCRAPING THE BOTTOM WALL OF A COKE OVEN CHAMBER

[75] Inventors: Gottfried Mertens; Walter Stanke, both of Essen, Fed. Rep. of Germany

[73] Assignee: Krupp-Koppers GmbH, Essen, Fed. Rep. of Germany

[21] Appl. No.: 858,526

[22] Filed: Dec. 7, 1977

[30] Foreign Application Priority Data

Dec. 17, 1976 [DE] Fed. Rep. of Germany ..... 2657227

[51] Int. Cl.[2] ..... B08B 7/00; C10B 43/04

[52] U.S. Cl. ..... 134/6; 15/93 A; 134/39; 201/2; 202/241

[58] Field of Search ..... 202/241; 201/2; 15/93 A; 134/6, 8, 39

[56] References Cited

U.S. PATENT DOCUMENTS

| | | | |
|---|---|---|---|
| 2,391,443 | 12/1945 | Bruton | 202/241 X |
| 3,196,088 | 7/1965 | Coleman et al. | 202/241 |
| 3,522,016 | 7/1970 | Groves et al. | 202/241 X |
| 3,741,806 | 6/1973 | Stanke et al. | 202/241 X |
| 3,955,232 | 5/1976 | Komno | 202/241 X |
| 3,972,781 | 8/1976 | Gonye et al. | 202/241 |

*Primary Examiner*—Joseph Scovronek
*Attorney, Agent, or Firm*—Michael J. Striker

[57] ABSTRACT

The invention is concerned with an apparatus for scraping the bottom wall of a coke oven chamber adjacent the chamber opening so as to remove deposits which would otherwise prevent the sealing insertion of the chamber door into the opening. The apparatus has a support which can be inserted into and withdrawn from the chamber opening. A scraping tool is mounted on the support so that it can pivot between an upwardly tilted position which it assumes as the apparatus is being inserted into the chamber opening, and a downwardly tilted position in which a horizontally extending scraping edge of the tool engages the bottom wall of the coke oven chamber to scrape away deposits therefrom as the support is withdrawn from the chamber opening. A biasing arrangement biases the scraping tool into engagement with the bottom wall when the scraping tool is in the downwardly pivoted position.

10 Claims, 3 Drawing Figures

METHOD AND APPARATUS FOR SCRAPING THE BOTTOM WALL OF A COKE OVEN CHAMBER

BACKGROUND OF THE INVENTION

The present invention relates generally to an apparatus for removing deposits from a coke oven chamber.

More particularly, the invention relates to an apparatus for scraping the bottom wall of a coke oven chamber adjacent the chamber opening in order to remove deposits which prevent sealing insertion of the chamber door into the opening.

Cook oven chambers have laterally facing openings which are bounded by a door frame, and a door which is removed in toto from the opening when the contents of the chamber are to be expelled through the opening. The door frame and the door have surfaces which sealingly contact one another in order to prevent — during the operation of the coke oven — the escape of noxious gases into the ambient atmosphere. The sealing surfaces on the door and on the frame bounding the opening of the coke oven chamber must be cleaned from time to time in order to remove from them deposits which accumulate and which, if not removed, will prevent proper sealing action. However, deposits also form on the bottom wall of the coke oven chamber and to the extent that they form immediately inwardly of the chamber opening they can prevent the proper sealing insertion of the chamber door into the opening so that is becomes difficult to insert the door; in fact, these deposits on the bottom wall of the chamber may prevent the insertion of the door to the extent necessary to obtain a proper sealing.

This problem is recognized and heretofore the deposits on the bottom wall of coke oven chambers have been removed manually. This is not only time-consuming but also represents a rather unpleasant and tedious job for the person charged with such removal. It is therefore desirable to provide equipment which is capable of carrying out such removal of deposits from the bottom wall of a coke oven chamber without the need to resort to manual labor. Heretofore, however, no such equipment has been in existence.

SUMMARY OF THE INVENTION

Accordingly, it is an object of the present invention to provide equipment of the type under discussion.

More particularly, it is an object of the invention to provide an apparatus for the scraping of the bottom wall of a coke oven chamber adjacent the chamber opening to remove deposits which prevent sealing insertion of the chamber door into the opening.

Another object of the invention is to provide such an apparatus which assures reliable removal of the deposits without requiring manual intervention.

An additional object of the invention is to provide such an apparatus which is simple and uncomplicated, and which is highly reliable in its operation.

In keeping with these objects, and with others which will become apparent hereafter, one feature of the invention resides in an apparatus for scraping the bottom of a coke oven chamber adjacent the chamber opening so as to remove deposits which prevent sealing insertion of the chamber door into the opening. According to the invention this apparatus may comprise support means insertable into the chamber opening, a scraping tool having a normally horizontally extending scraping edge, means mounting the scraping tool on the support means for movement relative to the same in a raised inserting position and a lower working position in which latter the scraping edge is oriented to scrape the bottom wall of the coke oven chamber, and means biasing the scraping tool towards the working position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
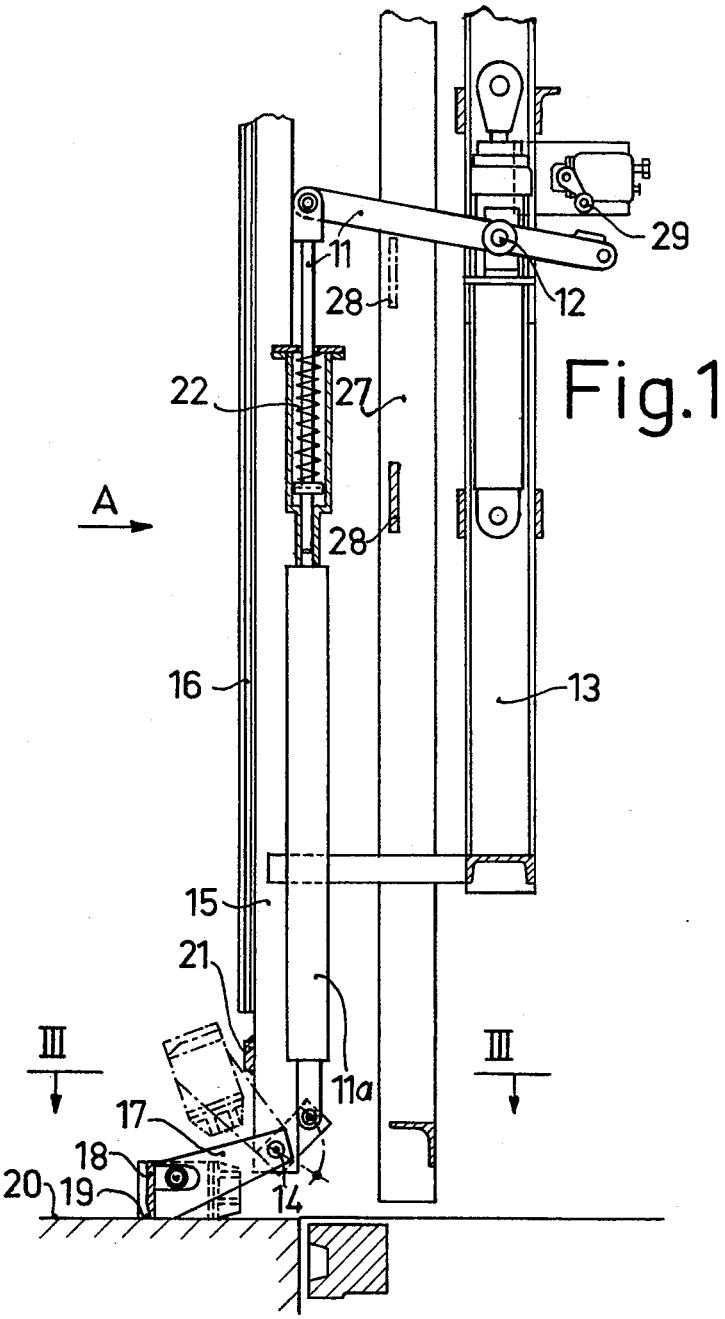
FIG. 1 is a fragmentary side view of an apparatus embodying the invention, partly in section.
Figure 2:
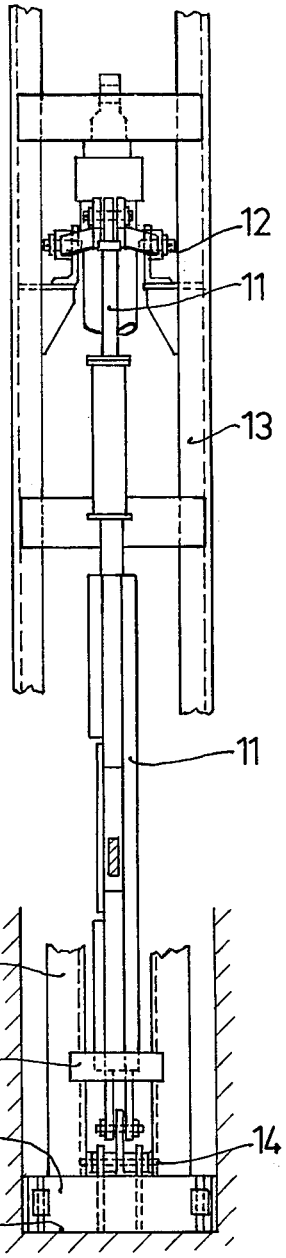
FIG. 2 is a view of the apparatus as seen in the direction of the arrow A of FIG. 1.
Figure 3:
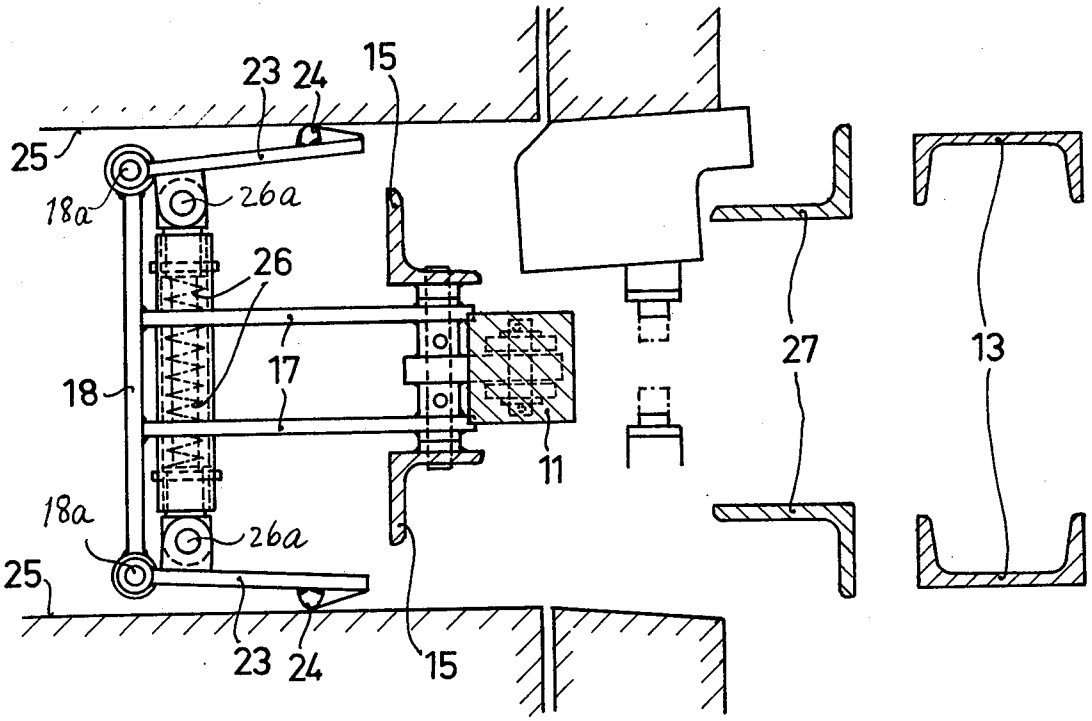
FIG. 3 is a section taken on line III—III of FIG. 1.

FIGS. 1–3 illustrate an exemplary embodiment of the invention. Only those components of the apparatus have been shown which are necessary for an understanding of the invention. The apparatus can normally be incorporated as part of a conventional cleaning apparatus for cleaning the door frame bounding the opening of a coke oven chamber. Such cleaning apparatuses are known, their purpoe being to remove deposits from the sealing surfaces of the door frame against which the door of the coke oven chamber is to be seated. Since such apparatuses are known, no details thereof have been illustrated herein.

The apparatus according to the present invention, however, is fully illustrated and it will be seen that it comprises a linkage composed of the illustrated elements 11, which linkage is pivoted at 12 to the supporting frame of the previously mentioned apparatus for cleaning the seating surfaces of a coke oven chamber doorframe. In addition, the linkage 11 is provided at 14 to a frame 15 which is connected with the frame 13 and which carries a heat shield 16. It should be understood that, for example with reference to FIG. 1, the right-hand side of the apparatus will be facing inwardly of the coke oven chamber, the bottom wall 20 of which is diagrammatically illustrated, whereas the left-hand side (counter to the arrow A) will be facing outwardly of the opening of the coke oven chamber. The purpose of the shield 16 is to protect persons who may be standing outside the opening of the chamber against the heat emanating therefrom after the door has been removed (not shown) and the apparatus according to the invention is inserted into the opening of the chamber.

The lower end of the linkage 11 has pivoted to it an element 17 which is connected with it via the pivot or pivots 14. Element 17 carries a scraping tool 18 having a lower horizontally extending scraping edge 19. The element 17 with the tool 18 thereon can be pivoted between two positions, namely an upper inclined position (shown in broken lines in FIG. 1) and a lower working position (shown in solid lines in FIG. 1). In the solid-line position, the scraping edge 19 engages the bottom wall 20 of the coke oven chamber so that, when the apparatus is withdrawn from the chamber subsequent to its original insertion (i.e. when it is moved counter to the direction of the arrow A) the edge 19 will scrape deposits off the bottom wall 20 which would otherwise prevent the proper insertion of the door (not shown) into the opening of the coke oven chamber.

For purposes of insertion of the apparatus into the coke oven chamber the element 17 with the tool 18 thereon is pivoted to the upwardly inclined position which is shown in broken lines in FIG. 1. The extent of upward movement of the element 17 is limited by the presence of an abutment 21 which is provided on the frame 15 and which is engaged by the element 17 when the same assumes the broken-line position. This pivoting is the result of a downward movement of the component 11*a* of the linkage 11. A biasing element 22, e.g. a spring, is also interposed in the linkage 11 as illustrated in FIG. 1 so as to exert upon the element 17 and the tool 18 a biasing force which presses the scraping edge 19 against the bottom wall 20 of the coke oven chamber when the element 17 is in the solid-line working position.

The drawings also show, particularly clearly in FIG. 3, that a pair of side wall scrapers 23, 23 is pivoted to opposite ends of the horizontally elongated tool 18, at pivot points which are designated with reference numerals 18*a*. The side wall scrapers 23 have scraping edges 24 which, in the solid-line position of element 17 assume a vertically or substantially vertical orientation and which serve to scrape upright side walls of the coke oven chamber in the lower region of these side walls i.e. in the region adjacent the bottom wall 20. The side walls are designated with reference numeral 25. A biasing element 26 is pivoted at 26*a* to the side wall scrapers 23 and urges them apart into scraping engagement of their edges 24 with the side walls 25. In the operating position shown in FIG. 3 the scraping edges 24 extend parallel to the planes of the side walls 25 whereas in the upwardly tilted (broken-line) position of FIG. 1 they are inclined with reference to one another and to the side walls in order to facilitate insertion into the coke oven chamber through the opening thereof.

The displacement of the element 17 and tool 18 is effected by means of a frame 27 which is mounted on the frame 13 so that it can be raised and lowered relative to the same. When the apparatus is to be inserted into the coke oven chamber the frame 27 is in its lowered position in which an abutment 28 provided on the frame 27 assumes the position shown in full lines in FIG. 1. At this time the weight of the linkage 11 by itself is sufficient to pivot the element 17 to the upwardly inclined broken-line position. Subsequent to insertion of the apparatus into the coke oven chamber the frame 27 is raised which causes (in a manner not illustrated because it is conventional and does not form a part of the invention) the cleaning tools for cleaning the door frame of the coke oven chamber to assume their upper operating position (not shown). This same upward movement of the frame 27 causes the abutment 28 thereof to move to the broken-line position shown in FIG. 1, in which it engages the upper cross-bar of the linkage 11 and retracts the linkage 11 upwardly so that the component 11*a* thereof also moves upwardly, causing the member 17 and the tool 18 to become pivoted downwardly to the illustrated full solid-line working position. When the tools (not shown) which clean the seating surfaces of the door frame have completed their work the apparatus is retracted from the coke oven chamber and during this retraction (leftward in FIG. 1) the scraping edge 19 scrapes over the bottom wall 20 and the scraping edges 24 scrape over the side walls 25, removing deposits thereon. These dislodged deposits are pushed out of the opening of the coke oven chamber by the scraping edges 19, 24 during the retraction of the apparatus. This, then, leaves the bottom wall 20 and the lower portions of the side walls 25 adjacent the opening of the coke oven chamber free of deposits so that the door can be properly and sealingly inserted into the opening for engagement of its sealing surfaces with the sealing surfaces of the frame bounding the opening.

After retraction of the apparatus out of the coke oven chamber the frame 27 is moved downwardly until the abutment 28 assumes the full-line position shown in FIG. 1, permitting the linkage 11, 11*a*, also to move downwardly under its own weight and to pivot the element 17 with the tools 18, 23 thereon to pivot upwardly to the broken-line position in FIG. 1. The upper cross-bar of the linkage 11 at this time also moves into engagement with a limit switch 29 (FIG. 1) which is connected electrically with the drive of the apparatus (not shown) and which prevents an insertion of the apparatus into the coke oven chamber unless the element 17 with the tools 18, 23 thereon is in the upper broken-line position. The manner in which this is done, however, forms no part of the invention and therefore need not be described in detail.

The invention disclosed herein is susceptible of a variety of changes and modifications all of which are intended to be encompassed in the appended claims. For example, the abutment 28 could be omitted and the movement of the linkage 11, 11*a* controlled by a separate drive, for example by a hydraulic cylinder and piston unit which could be connected to the cross-bar 11 to pivot the same upwardly or downwardly about the pivot 12. The tools 23 are advantageous but need not be present; if they were omitted the primary purpose of the invention, namely to remove deposits from the bottom wall 20 by scraping them off the same, would still be accomplished by the scraping edge 19 of the tool 18. It is a particular advantage of the apparatus that the biasing elements 22 and 26 which act upon the tools 18 and 23, respectively, not only cause the scraping edges to firmly engage the walls which they are to clean, but also permit the scraping edges to "ride" over small projections or unevennesses of the respective walls so as to avoid damage to the tools and/or walls which would occur if the tools could not so yield.

While the invention has been illustrated and described as embodied in an apparatus for scraping the bottom wall of a coke oven chamber adjacent the chamber opening, it is not intended to be limited to the details shown since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or or specific aspects of this invention.

What is claimed as new and desired to be protected by Letters Patent is set forth in the appended claims:

1. In an apparatus for scraping the bottom wall of a coke oven chamber adjacent the chamber opening so as to remove deposits which prevent sealing insertion of the chamber door into the opening, a combination comprising support means insertable into the chamber opening axially thereof; a scraping tool having a normally horizontally extending scraping edge; means mounting said scraping tool on said support means for movement relative to the same between a raised inserting position and a lower working position in which latter said edge is oriented to scrape the bottom wall of the coke oven chamber in response to movement of said support means axially of said chamber; and means biasing said scraping tool towards said working position.

2. A combination as defined in claim 1, said support means comprising a substantially vertically movable support member; and further comprising an abutment on said support member movable with the same and engageable with said mounting means to control the movement of said scraping tool between said positions thereof.

3. A combination as defined in claim 1; and further comprising drive means operatively connected with said mounting means to control the movement of said scraping tool between said positions thereof.

4. A combination as defined in claim 3, said drive means comprising a hydraulic cylinder.

5. A combination as defined in claim 1, said coke oven chamber also having lateral walls which extend upwardly from the bottom wall; and further comprising scraper members mounted at lateral sides of said scraping tool, and means urging said scraper members into scraping engagement with the respective lateral walls.

6. A combination as defined in claim 5, wherein said scraper members have respective scraper edges which are substantially vertically oriented when said scraping tool is in said working position thereof.

7. A combination as defined in claim 5, wherein said scraper members converge in direction inwardly of said opening when said scraping tool is in said raised position thereof to facilitate the insertion of said tool and scraper members into said opening.

8. A combination as defined in claim 1, said mounting means comprising pivot means about which said scraping tool tilts between said positions thereof.

9. A combination as defined in claim 1, said scraping tool being elongated lengthwise of said scraping edge and said chamber having side walls extending upwardly from said bottom wall; further comprising a pair of side wall scrapers mounted to opposite endportions of said scraping tool for tilting about upright pivot axes when said tool is in said working position; and biasing spring means extending along and parallel to said tool and bearing upon said sidewall scrapers to pivot the same apart from one another.

10. A method of scraping the bottom wall of a coke oven chamber adjacent the chamber opening to remove deposits which prevent sealing insertion of the chamber door into the opening, comprising the steps of inserting through the opening and axially into the chamber an arrangement having an upwardly inclined scraper tool facing outwardly of the opening subsequent to the insertion and which is provided with a substantially horizontal scraping edge; changing the inclination of the tool until the scraping edge engages the bottom wall of the chamber; and retracting the arrangement through the opening axially of the chamber so that the scraping edge scrapes over the bottom wall and removes deposits from the same.

* * * * *